US008511925B2

(12) United States Patent
Noguchi

(10) Patent No.: US 8,511,925 B2
(45) Date of Patent: Aug. 20, 2013

(54) LIQUID SUPPLY DEVICE

(75) Inventor: Yoshio Noguchi, Kawagoe (JP)

(73) Assignee: Kotobuki & Co., Ltd., Kawagoe-Shi, Saitama (JP)

( * ) Notice: Subject to any disclaimer, the term of this patent is extended or adjusted under 35 U.S.C. 154(b) by 241 days.

(21) Appl. No.: 12/998,697

(22) PCT Filed: Nov. 11, 2009

(86) PCT No.: PCT/JP2009/069059

§ 371 (c)(1),
(2), (4) Date: May 20, 2011

(87) PCT Pub. No.: WO2010/061719

PCT Pub. Date: Jun. 3, 2010

(65) Prior Publication Data

US 2011/0222953 A1 Sep. 15, 2011

(30) Foreign Application Priority Data

Nov. 27, 2008 (JP) ..... 2008-303251

(51) Int. Cl.
*A46B 11/02* (2006.01)

(52) U.S. Cl.
USPC ..... 401/188 A; 401/101; 401/112; 401/187

(58) Field of Classification Search
USPC ..... 401/109–112, 101, 187, 188 R, 188 A, 401/143
See application file for complete search history.

(56) References Cited

U.S. PATENT DOCUMENTS

| | | | | |
|---|---|---|---|---|
| 3,415,603 | A * | 12/1968 | Blanchard | 401/101 |
| 7,303,349 | B2 | 12/2007 | Murakoshi | |
| 7,604,427 | B2 | 10/2009 | Taniguchi | |
| 7,819,601 | B2 * | 10/2010 | Taniguchi | 401/188 A |
| 2005/0063767 | A1 | 3/2005 | Kobayashi | |
| 2008/0019761 | A1 | 1/2008 | Taniguchi | |

FOREIGN PATENT DOCUMENTS

| | | | |
|---|---|---|---|
| EP | 1 880 868 | A1 | 1/2008 |
| JP | 2000-335173 | A | 12/2000 |
| JP | 2005-125686 | A | 5/2005 |
| JP | 2005-246648 | A | 9/2005 |
| JP | 2006-272776 | A | 10/2006 |
| JP | 3929360 | B2 | 3/2007 |
| JP | 2007-152745 | A | 6/2007 |
| JP | 2008-044338 | A | 2/2008 |
| JP | 2008-120033 | A | 5/2008 |
| JP | 2009-226674 | A | 10/2009 |

OTHER PUBLICATIONS

Japanese Office Action dated Apr. 3, 2012.
European Search Report dated Feb. 11, 2013.

* cited by examiner

*Primary Examiner* — David Walczak
(74) *Attorney, Agent, or Firm* — McGinn IP Law Group, PLLC

(57) ABSTRACT

A liquid supply device utilizing a rotating cam mechanism for supplying a liquid. In the liquid supply device for smoothly supplying a liquid with the assistance of pressurizing action, switching operation by the rotating cam mechanism can be carried out reliably.

A rotating cam mechanism 16 which can move the liquid housing tube 14 forward and backward includes a rotating cam 40 movable between a front position and a rear position and a pressurizing space 18 to be compressed to be able to pressurize an inside of the liquid housing tube 14 when the tip end chip 32 is in the protruding position is provided in a rear portion in the rotating cam 40.

14 Claims, 6 Drawing Sheets

(a)

(b)

LIQUID SUPPLY DEVICE

TECHNICAL FIELD

The present invention relates to a liquid supply device utilizing a rotating cam mechanism for supplying a liquid (including semisolid fluid such as gel and high-viscosity liquid) for writing, correction, makeup, and medical use and to a liquid supply device for smoothly supplying a liquid with the assistance of pressurizing action.

BACKGROUND ART

As this type of liquid supply, conventionally, there is a generally known one in which a rotating cam mechanism provided in an outer shaft is used to cause a tip end supplying portion to protrude from and retract into the outer barrel. For protrusion and retraction of the tip end supplying portion, a known rotating cam mechanism consisting of a rotating cam, a knock member, and a cam main body is used in general. The rotating cam mechanism can carry out switching operation in which the rotating cam rotates a predetermined angle every time the knock member presses the rotating cam to move alternately between a front position and a back position. When the rotating cam is in the front position, the tip end supplying portion protrudes from a tip end of the outer shaft. When the rotating cam is in the back position, the tip end supplying portion retracts into the outer shaft.

A structure for smoothly supplying a liquid by pressurizing action synchronized with actuation of the above-mentioned rotating cam mechanism is proposed in each of Patent Documents 1 to 6, for example.

In the structure proposed in each of Patent Documents 1 to 6, a pressurizing space which can communicate with an inside of a liquid housing tube is provided in the outer shaft and the pressurizing space is open to atmospheric pressure when the rotating cam is in the back position and becomes a pressurizing sealed space when the rotating cam is in the front position. Therefore, when the rotating cam moves to the front position to supply the liquid and the tip end supplying portion protrudes, the inside of the liquid housing tube is pressurized and it is possible to smoothly supply the liquid with the assistance of the pressurizing action.

PRIOR ART DOCUMENT

Patent Document

Patent Document 1: Japanese Patent No. 3929360
Patent Document 2: Japanese Patent Unexamined Publication No. 2005-125686
Patent Document 3: Japanese Patent Unexamined Publication No. 2008-120033
Patent Document 4: Japanese Patent Unexamined Publication No. 2005-246648
Patent Document 5: Japanese Patent Unexamined Publication No. 2007-152745
Patent Document 6: Japanese Patent Unexamined Publication No. 2006-272776

SUMMARY OF THE INVENTION

Technical Problem

Reliable switching operation by the rotating cam mechanism is based on stable forward and backward axial movements of the rotating cam.

However, in the prior-art structure, the pressurizing sealed space is formed as the rotating cam moves forward and therefore the forward movement of the rotating cam is obstructed by the pressurizing sealed space and it is difficult for the rotating cam to stably carry out the axial movement.

The present invention has been made with such a problem in view and the object of the present invention is to provide a liquid supply in which switching operation by a rotating cam mechanism can be carried out reliably.

Solution to Problem

To achieve the above object, according to the present invention, there is provided a liquid supply including:

an outer barrel;

a liquid housing tube disposed to be movable in an axial direction in the outer shaft, having a tip end supplying portion movable between a protruding position from a tip end of the outer shaft and a retracting position in the outer shaft, and housing a liquid;

a rotating cam mechanism capable of moving the liquid housing tube forward and backward, including a rotating cam movable between a front position and a rear position in which the rotating cam can be switched between the front position and the rear position due to axial movement and rotation of the rotating cam; and a pressurizing space provided in the outer shaft compressed to be able to pressurize an inside of the liquid housing tube when the tip end supplying portion is in the protruding position, wherein the rotating cam is adapted to receive an axial forward force from the pressurizing space.

The pressurizing space may be formed in a rear portion in the rotating cam.

An air communication means for connecting the pressurizing space and atmospheric pressure may be formed at a rear portion of the rotating cam.

The rotating cam mechanism may include a push-out member capable of pressing the rotating cam in the axial direction so as to cause axial movement of the rotating cam and the push-out member may be integrally provided with a piston capable of compressing the pressurizing space.

A biasing member for biasing the push-out member backward with respect to the rotating cam may be interposed between the push-out member and the rotating cam and the push-out member can move further backward after the rotating cam moves to the rear position.

A backward displacement regulating mechanism for regulating backward displacement of the push-out member when the rotating cam is in the front position may be provided between the push-out member and the rotating cam.

The backward displacement regulating mechanism may be a protrusion formed on a surface of one of the rotating cam and the push-out member facing the other of them, a locking protrusion to be engaged with the protrusion, and a locking groove into which the protrusion can be inserted, the locking protrusion and the locking groove formed on a surface of the other of the rotating cam and the push-out member and facing the one of them, and the locking protrusion and the locking groove are formed alternately in a circumferential direction.

A partitioning wall for dividing an inner portion of the rotating cam into a front portion and a rear portion may be formed in the rotating cam, the pressurizing space may be formed behind the partitioning wall of the rotating cam, and a communication hole for communicating with the liquid housing tube may be formed in the partitioning wall.

A sealing member may be provided between the rotating cam and a rear end or a peripheral surface of the liquid housing tube.

According to the present invention, there is provided a liquid supply device including:

an outer shaft;

a liquid housing tube disposed to be movable in an axial direction in the outer shaft, having a tip end supplying portion movable between a protruding position from a tip end of the outer shaft and a retracting position in the outer shaft, and housing a liquid;

a rotating cam mechanism capable of moving the liquid housing tube forward and backward, including a rotating cam movable between a front position and a rear position in which the rotating cam can be switched between the front position and the rear position due to axial movement and rotation of the rotating cam; and a pressurizing space provided in the outer shaft and compressed to be able to pressurize an inside of the liquid housing tube when the tip end supplying portion is in the protruding position, wherein the pressurizing space is provided in a rear space in the rotating cam or behind the rotating cam.

According to the present invention, there is provided a liquid supply device including:

an outer shaft;

a liquid housing tube disposed to be movable in an axial direction in the outer shaft, having a tip end supplying portion movable between a protruding position from a tip end of the outer shaft and a retracting position in the outer shaft, and housing a liquid;

a rotating cam mechanism capable of moving the liquid housing tube forward and backward, including a rotating cam movable between a front position and a rear position in which the rotating cam can be switched between the front position and the rear position due to axial movement and rotation of the rotating cam; and a pressurizing space provided in the outer shaft and compressed to be able to pressurize an inside of the liquid housing tube when the tip end supplying portion is in the protruding position, wherein a piston for compressing the pressurizing space is provided and the piston is relatively movable with respect to the rotating cam.

The rotating cam mechanism may have a push-out member capable of pressing the rotating cam in the axial direction so as to cause axial movement of the rotating cam and the piston may be integrally provided to the push-out member.

A biasing member for biasing the push-out member backward with respect to the rotating cam may be interposed between the push-out member and the rotating cam and the push-out member can move further backward after the rotating cam moves to the rear position.

A backward displacement regulating mechanism for regulating backward displacement of the push-out member when the rotating cam is in the front position may be provided between the push-out member and the rotating cam.

The backward displacement regulating mechanism may be a protrusion formed on a surface of one of the rotating cam and the push-out member facing the other of them, a locking protrusion to be engaged with the protrusion, and a locking groove into which the protrusion can be inserted, the locking protrusion and the locking groove formed on a surface of the other of the rotating cam and the push-out member and facing the one of them, and the locking protrusion and the locking groove are formed alternately in a circumferential direction.

According to the present invention, there is provided a ballpoint pen including:

an outer shaft;

a liquid housing tube disposed to be movable in an axial direction in the outer shaft, having a tip end supplying portion movable between a protruding position from a tip end of the outer shaft and a retracting position in the outer shaft, and housing a liquid; and a rotating cam mechanism capable of moving the liquid housing tube forward and backward, including a rotating cam movable between a front position and a rear position in which the rotating cam can be switched between the front position and the back position by axial movement and rotation of the rotating cam, wherein a pressurizing space formed in the outer shaft and compressed to be able to pressurize an inside of the liquid housing tube when the tip end supplying portion is in the protruding position is provided, and the tip end supplying portion has a ball having a ball diameter of 1 mm or larger.

ADVANTAGEOUS EFFECTS OF INVENTION

According to the present invention, when the rotating cam moves forward, the pressurizing space does not obstruct the forward movement of the rotating cam. Rather, pressure in the pressurizing space can assist the forward movement of the rotating cam. Therefore, the forward movement of the rotating cam can be carried out stably and the switching operation by the rotating cam mechanism can be carried out reliably.

DESCRIPTION OF EMBODIMENTS

An embodiment of the present invention will be described hereafter with reference to the drawings.

Figure 1:
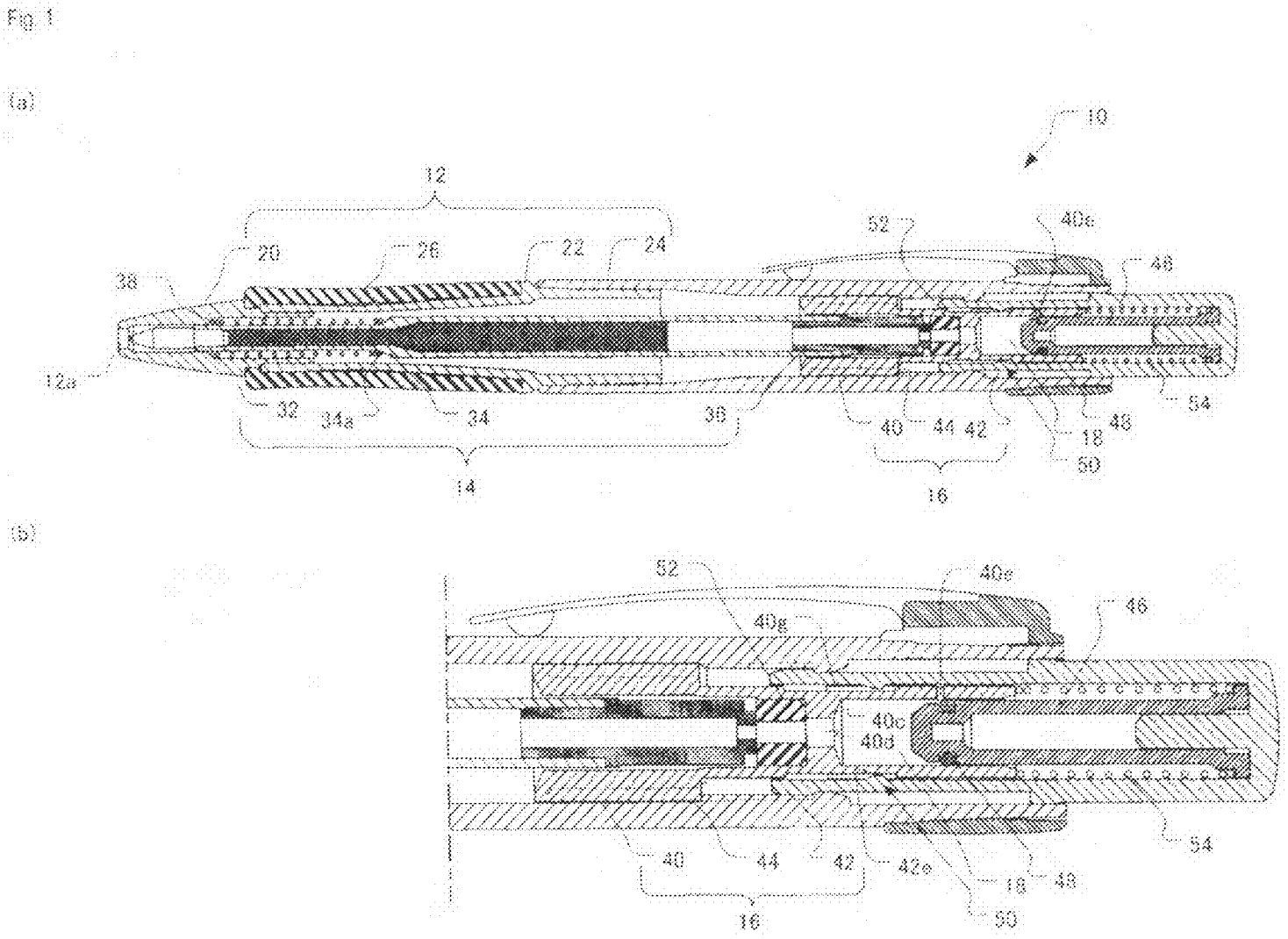
FIG. 1(*a*) is an overall sectional view and FIG. 1(*b*) is a partial sectional view and a housed state of a liquid supply device according to an embodiment of the present invention.

FIG. 1 is an overall sectional view of a liquid supply device according to the invention.

Generally, a liquid supply device 10 includes an outer shaft 12, a liquid housing tube 14, a rotating cam mechanism 16, and a pressurizing space 18 formed in the outer shaft 12.

Although the outer shaft 12 may consist of a single part, it consists of a tip member 20 defining a tip end opening 12*a* of the outer shaft 12, a front shaft 22 connected to a rear end of the tip member 20 in a detachable or undetachable manner by screwing, bonding, press-fitting, or the like, a rear shaft 24 connected to a rear end of the front shaft 22 in a detachable or undetachable manner by screwing, bonding, press-fitting, or the like, and a gripper 26 provided on outer peripheries of parts of the front shaft 22 and the tip member 20 and made of soft material, in the example shown in the drawing. The tip member 20, the front shaft 22, and/or the rear shaft 24 may be suitably made of synthetic resin or metal.

In the outer shaft 12, the liquid housing tube 14 for housing a liquid is disposed to be movable in an axial direction of the outer shaft 12. The liquid housing tube 14 is in a form of a ballpoint refill in the example shown in the drawing. However, it is not limited to this form but may be in an arbitrary form and of an arbitrary structure. Although the liquid housing tube 14 also can consist of arbitrary number of parts including a single part, it consists of a tip end chip 32 which is a tip end supplying portion for supplying the liquid, a tank tube 34 for housing the liquid, and a tank rear end receiver 36 in sealingly contact with a rear end of the tank tube 34, in the example shown in the drawings. In a tip end in the tip end chip 32, a ball (not shown) is housed.

The liquid housing tube 14 is movable in the outer shaft 12 so as to move between a protruding position in which the tip end chip 32 protrudes from the tip end opening 12*a* of the outer shaft 12 and a retracting position in which the tip end chip 32 retracts from the tip end opening 12*a* of the outer shaft 12. The liquid housing tube 14 is constantly biased backward, i.e., toward the position in which the tip end chip 32 retracts, by a return spring 38 interposed between an inner peripheral face of the tip member 20 and a spring receiving step portion 34*a* formed on the tank tube 34.

In a rear portion in the outer shaft 12, the rotating cam mechanism 16 which can move forward and backward in the liquid housing tube 14 is disposed. The rotating cam mechanism 16 consists of a rotating cam 40, a push-out member 42, and a cam main body 44.

In this example, the cam main body 44 is formed on an inner peripheral face of the rear shaft 24 of the outer shaft 12. However, the cam main body 44 can be provided on an arbitrary member which is not the rear shaft 24 and which is fixed to the outer shaft 12.

Figure 2:
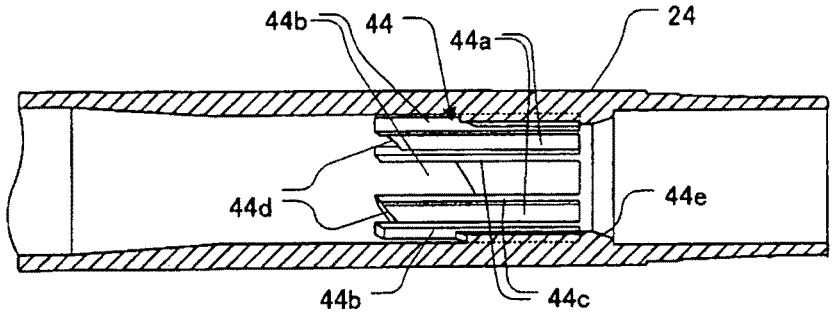
FIG. 2 is a sectional view of a cam main body of a rotating cam mechanism in the liquid supply device in FIG. 1.

As shown in FIG. 2, first grooves 44*a* and second grooves 44*b* are formed alternately in the cam main body 44 with ridges 44*c* interposed therebetween in a circumferential direction. The first grooves 44*a* and the second grooves 44*b* are deep at their front portions and shallow at their rear portions. While the first grooves 44*a* have almost no deep groove portions, the second grooves 44*b* have deep groove portions of a certain length. Front ends of the shallow groove portions of the grooves and front ends of the ridges 44*c* form cam oblique surfaces wherein the front ends of the shallow groove portions of the first grooves 44*a* and the front ends of the ridges 44*c* form continuous cam oblique surfaces 44*d*.

Figure 3:
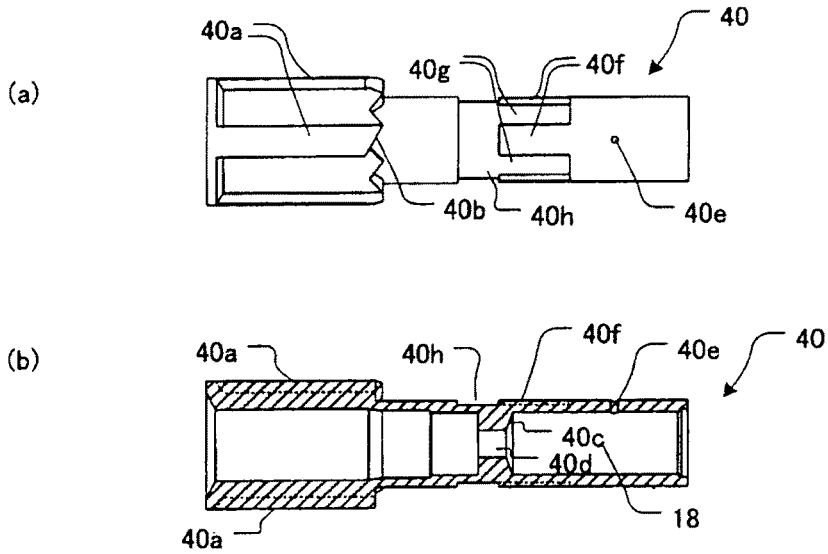
FIG. 3(*a*) is a side view and FIG. 3(*b*) is a sectional view of a rotating cam of the rotating cam mechanism in the liquid supply device in FIG. 1.

As shown in FIGS. 3(*a*) and 3(*b*), protrusions 40*a* are formed at intervals in the circumferential direction on an outer peripheral surface of the rotating cam 40. The protrusions 40*a* can be inserted into the respective deep groove portions of the first grooves 44*a* and the second grooves 44*b* of the cam main body 44, but cannot be inserted into the shallow groove portions of the grooves. Therefore, when the protrusions 40*a* are aligned with the first grooves 44*a*, the protrusions 40*a* abut against the front ends of the shallow groove portions of the first grooves 44*a* to bring the rotating cam 40 into the front position. When the protrusions 40*a* are aligned with the second grooves 44*b*, the protrusions 40*a* abut against the front ends of the shallow groove portions of the second grooves 44*b* to bring the rotating cam 40 into the rear position. Cam surfaces 40*b* are formed at rear ends of the protrusions 40*a*.

Figure 4:
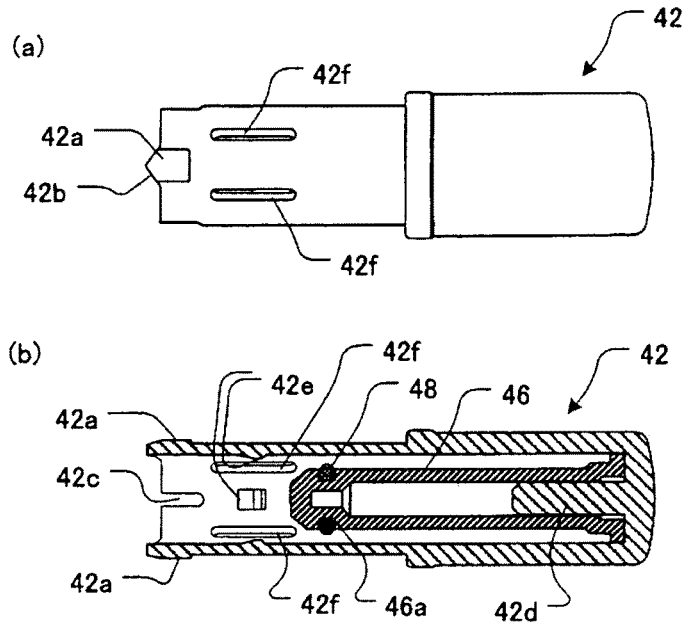
FIG. 4(*a*) is a side view and FIG. 4(*b*) is a sectional view of a push-out member of the rotating cam mechanism in the liquid supply device in FIG. 1.

On the other hand, a plurality of protrusions 42*a* are formed on a front end of the push-out member 42 as shown in FIGS. 4(*a*) and 4(*b*). The protrusions 42*a* are inserted into the second grooves 44*b* of the cam main body 44. Rearmost positions of the protrusions 42*a* are regulated by a step portion 44*e* formed on a rear end of the cam main body 44. In this way, withdrawal of the push-out member 42 from the cam main body 44 is prevented. It is preferable to form a plurality of slits 42*c* in a front end of the push-out member 42 in order to allow the protrusions 42*a* to pass over the step portion 44*e* of the cam main body 44 during assembly. The protrusions 42*a* of the push-out member 42 slide in the second grooves 44*b* of the cam main body 44 to push out the protrusions 40*a* of the rotating cam 40 forward. Crest-shaped cam surfaces 42*b* are formed at front ends of the protrusions 42*a* of the push-out member 42.

In the rotating cam mechanism 16 formed as described above, when the rotating cam 40 is pushed out by the push-out member 42, the rotating cam 40 rotates in one direction due to cooperation between the cam surfaces 40*b* of the protrusions 40*a* of the rotating cam 40, the cam surfaces 42*b*, and the cam oblique surfaces 44*d* of the cam main body 44 and due to a biasing force of the return spring 38 and the protrusions 40*a* are alternately aligned with the first grooves 44*a* and the second grooves 44*b* to thereby carry out the switchover operation of the rotating cam 40 between the front position and the rear position.

As shown in FIG. 3(*b*), the rotating cam 40 has a cylindrical shape. A partition wall 40*c* is formed at a center of an inner portion of the rotating cam 40 and a communication hole 40*d* is formed at a central portion of the partition wall 40*c*. In a peripheral surface of the rotating cam 40 behind the partition wall 40*c*, an air communication hole 40*e* as an air communication means for connecting between an inside and an outside of the rotating cam 40 is formed.

As shown in FIG. 4(*b*), the push-out member 42 has a bottomed cylindrical shape, a protruding portion 42*d* is formed at an inner portion of a rear end of the push-out member 42, and a piston 46 is connected to the protruding portion 42*d*. The push-out member 42 and the piston 46 may be formed as a single part. A sealingly contact member is provided on a peripheral surface of the piston 46. Specifically, the sealingly contact member is an O-ring 48 fitted in an annular groove 46*a* formed in a peripheral surface of a front portion of the piston 46. This sealingly contact member is elastically brought in hermetic contact with an inner peripheral surface of the rotating cam 40.

Figure 5:
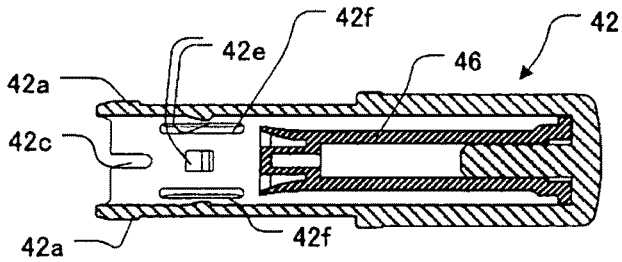
FIG. 5 is a sectional view of a modification of the push-out member of the rotating cam mechanism.

The sealingly contact member is not limited to this. As shown in FIG. 5, the front portion of the piston 46 may be spread out radially to form an enlarged portion and the enlarged portion may be elastically brought in hermetic contact with the inner peripheral surface of the rotating cam 40.

The pressurizing space 18 is formed in a rear portion inside the rotating cam 40. Specifically, the pressurizing space 18 is a space behind the partition wall 40*c*. Relative movement of the piston 46 with respect to the rotating cam 40 changes capacity of the pressurizing space 18 to change pressure in the pressurizing space 18.

Furthermore, between the outer peripheral surface of the rotating cam 40 and an inner peripheral surface of the push-out member 42, a backward displacement regulating mechanism 50 is provided. The backward displacement regulating mechanism 50 comprises locking protrusions 40*f* and locking grooves 40*g* formed alternately in a circumferential direction on an outer peripheral surface of the rotating cam 40, an annular groove 40*h*, and protrusions 42*e* formed on the inner peripheral surface of the push-out member 42. The protrusions 42*e* are inserted into the locking grooves 40*g* and the annular groove 40*h*. When the protrusions 42*e* are inserted into the locking grooves 40*g*, the push-out member 42 can be displaced backward with respect to the rotating cam 40 in a range of the locking grooves 40*g* (or in a range in which rearmost positions of the protrusions 42*a* of the push-out member 42 are regulated by the step portion 44*e* of the cam main body 44). When the protrusions 42*e* are in contact with the locking protrusions 40*f*, the backward displacement of the push-out member 42 with respect to the rotating cam 40 is prevented. It is preferable to suitably form slits 42*f* at the same axial positions as the protrusions 42*e* of the push-out member 42 in order to assist insertion of the protrusions 42*e* into the locking grooves 40*g* during assembly.

As the backward displacement regulating mechanism 50, it is also possible to form protrusions on the peripheral surface of the rotating cam 40 and locking grooves and locking protrusions in and on the peripheral surface of the push-out member 42.

As shown in FIG. 1, a packing cylinder 52 as a sealing member is inserted into the rotating cam 40. The packing cylinder 52 is interposed between a rear end of the liquid housing tube 14 and the partition wall 40*c* of the rotating cam 40 to achieve sealing between them. As a sealing member, the packing cylinder 52 preferably has such a shape and material as to be resilient in order to achieve sealing between the liquid housing tube 14 and the rotating cam 40. It is also possible to arbitrarily provide the sealing member between the peripheral surface of the liquid housing tube 14 and the peripheral surface of the rotating cam 40.

The pressurizing space 18 communicates with an inside of the tank tube 34 of the liquid housing tube 14 through the communication hole 40*d* and a center hole in the packing cylinder 52. Although the pressurizing space 18 and the tank tube 34 directly communicate with each other as the example shown in the drawings, they may communicate with each other through a check valve or the like.

A knock spring 54 is interposed between a rear end of the rotating cam 40 and an inner surface of a rear end of the push-out member 42. The knock spring 54 biases the push-out member 42 backward with respect to the rotating cam 40. A spring constant of the knock spring 54 is set to be smaller than that of the return spring 38.

In the example shown in the drawings, the rear end of the push-out member 42 protrudes from a rear end of the outer shaft 12 and functions as an operating portion. The operating portion is not limited to this and it is also possible to provide an operating portion which is not the push-out member 42 and which is connected to the push-out member 42. In this case, an operating direction of the operating portion is not limited to a knocking operation along the axial direction but may be a turning operation about the axial direction. In any case, it is only necessary that an operating force be converted to an axial movement of the push-out member 42.

Operation of the liquid supply device 10 formed as described above will be described.

FIG. 1 shows the housed state of the liquid supply device 10. At this time, in the rotating cam mechanism 16, the rotating cam 40 is in the rear position and the tip end chip 32 of the liquid housing tube 14 is in a retracting position from the tip end opening 12*a* of the outer shaft 12. The push-out member 42 is in the rearmost position due to the biasing force of the knock spring 54 and the piston 46 is also in the rearmost position. Therefore, the O-ring 48 which is the sealingly contact member is positioned on the rear side from the air communication hole 40*e* in the rotating cam 40 and the pressurizing space 18 communicates with atmospheric pressure through the air communication hole 40*e* and a clearance between members outside the air communication hole 40*e*.

Figure 6:
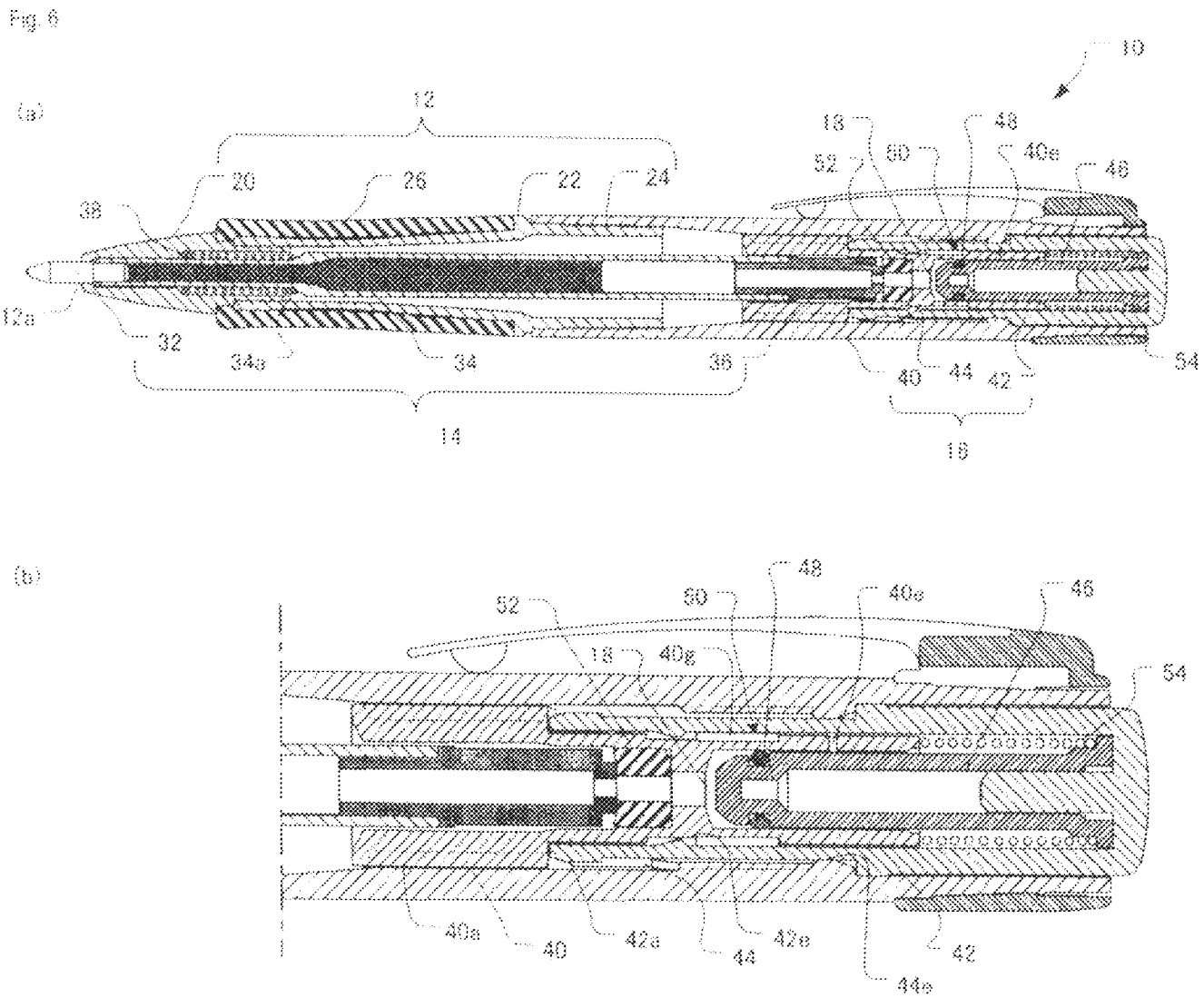
FIG. 6(*a*) is an overall sectional view and FIG. 6(*b*) is a partial sectional view showing a switchover of the liquid supply device in FIG. 1.

Now, in use the liquid supply device 10, when the push-out member 42 is operated and pushed out forward, the knock spring 54 is compressed first and the push-out member 42 and the piston 46 move forward with respect to the rotating cam 40. Because the O-ring 48 which is the sealing member of the piston 46 passes the air communication hole 40*e*, the pressurizing space 18 is sealed. When the push-out member 42 and the piston 46 move further forward, the front end of the push-out member 42 comes in contact with the rotating cam 40 to push the rotating cam 40 forward. When the rotating cam 40 is pushed farther forward than the cam main body 44 as shown in FIG. 6, the rotating cam 40 rotates a predetermined angle. If the enlarged portion at a rear portion of the push-out member 42 comes in contact with the step portion 44*e* of the cam main body 44, the push-out member 42 cannot move any further forward. At this time, because a clearance is formed between a tip end of the tank tube 34 of the liquid housing tube 14 and an inner surface of the tip member 20, it is possible to prevent damage to the tank tube 34 due to collision of the tank tube 34 of the liquid housing tube 14 with the inner surface of the tip member 20.

Figure 7:
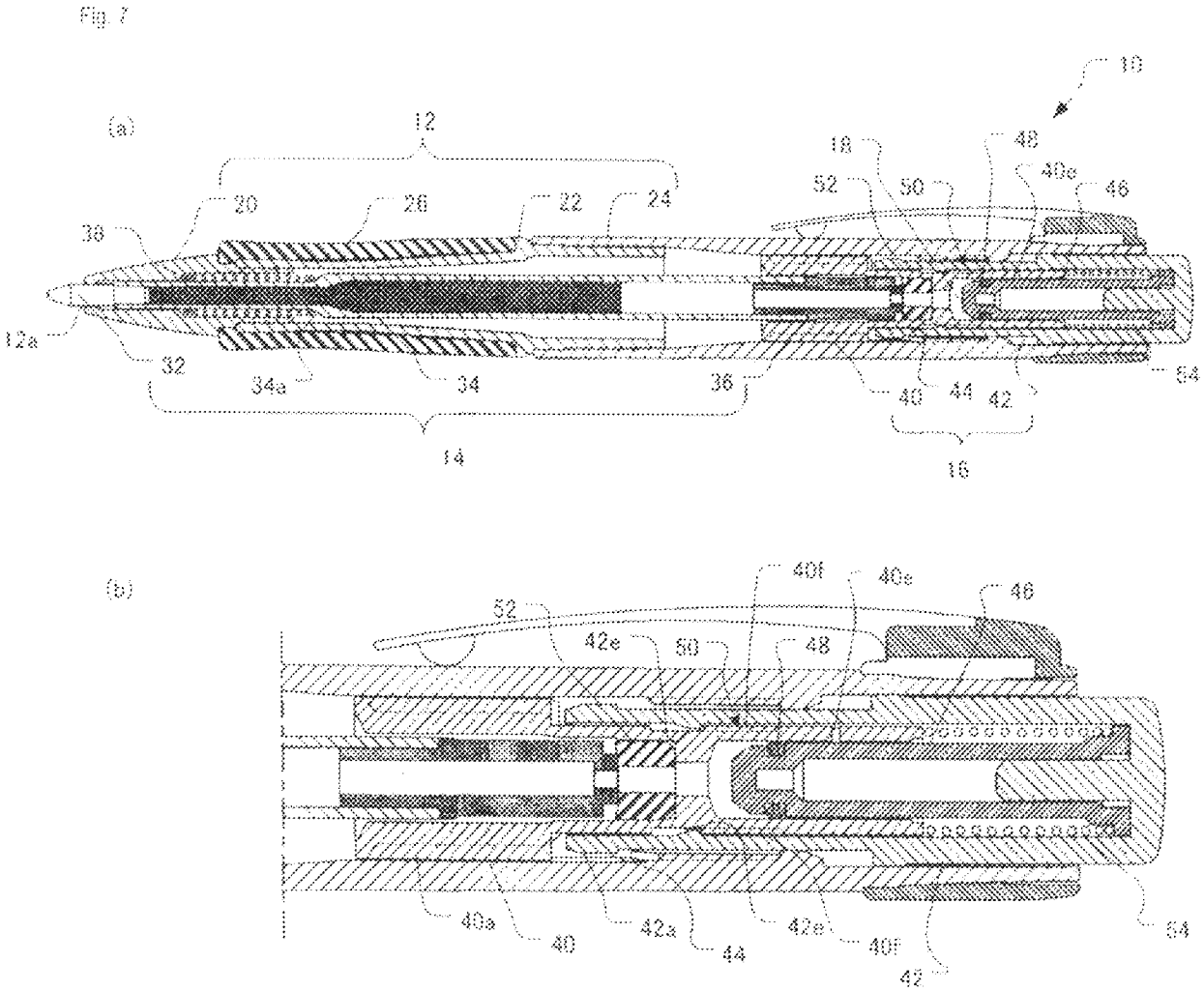
FIG. 7(*a*) is an overall sectional view and FIG. 7(*b*) is a partial sectional view showing a state in which writing action with the liquid supply device in FIG. 1 is available.

Then, when the pushing out of the push-out member 42 is released, as shown in FIG. 7, the rotating cam 40 moves to the front position as described above, the tip end chip 32 of the liquid housing tube 14 is in the protruding position from the tip end opening 12*a* of the outer shaft 12, and the liquid supply device 10 comes into a writable state. Although the push-out member 42 is moved backward by the knock spring 54, the backward movement of the push-out member 42 is regulated, because the rotating cam 40 rotates and the protrusions 42*e* of the push-out member 42 relatively move in the annular groove 40*h* of the rotating cam 40 to be abutted against the locking protrusions 40*f* in the backward displacement regulating mechanism 50.

In this way, the pressurizing space 18 is maintained in a compressed state. Therefore, the inside of the tank tube 34 of the liquid housing tube 14 is pressurized and the liquid in the tank tube 34 is smoothly supplied from the tip end chip 32 with the assistance of the pressurizing action.

To return from the writable state in FIG. 7 to the housed state in FIG. 1, the push-out member 42 is operated and pushed forward. As a result, the front end of the push-out member 42 comes in contact with the rotating cam 40 to push the rotating cam 40 forward. When the rotating cam 40 is pushed farther forward than the cam main body 44, the rotating cam 40 rotates a certain angle to come into a state shown in FIG. 6. Then, when the pushing out of the push-out member 42 is released, the rotating cam 40 and the push-out member 42 are pushed out backward by the biasing force of the return spring 38 and the rotating cam 40 returns to the rear position. Because regulation of the backward movement of the push-out member 42 by the backward displacement regulating mechanism 50 is cancelled by the rotation of the rotating cam 40, the push-out member 42 returns to the original position in FIG. 1 by the knock spring 54 after the rotating cam 40 returns to the rear position. By the backward movements of the push-out member 42 and the piston 46 with respect to the rotating cam 40 by the knock spring 54 in this manner, the pressurizing space 18 is expanded and opened to the atmospheric pressure and brought into a standby state for the next compression.

A volume of the liquid in the tank tube 34 corresponding to a stroke difference between a position of the piston 46 in FIG. 1 and a position of the piston 46 in FIG. 7 is a volume which can be supplied by a single operation.

Because the pressurizing space 18 is at the rear of the rotating cam 40, the pressurizing space 18 does not obstruct the forward movement of the rotating cam 40 during the above-described operation and the rotating cam 40 can stably move forward. Therefore, it is possible to reliably carry out the switchover operation of the rotating cam mechanism 16. Rather, pressure in the pressurizing space 18 acts on the partition wall 40*c* of the rotating cam 40 and the rotating cam 40 can receive a forward force in the axial direction. The pressurizing space 18 can assist the forward movement of the rotating cam 40.

Although the pressurizing space 18 is formed in the rear portion in the rotating cam 40 in the above-described example, it may be provided behind the rotating cam 40 and pressure in the pressurizing space 18 may be indirectly transmitted to the rotating cam 40.

Figure 8:
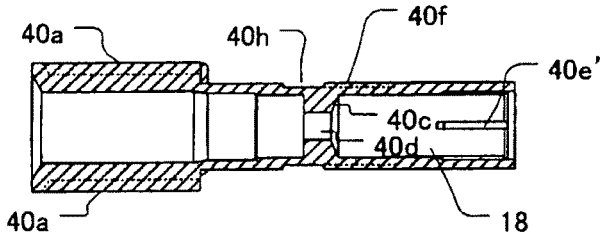
FIG. 8 is a sectional view of the rotating cam and showing another example of air communication means formed in the rotating cam.
Figure 9:
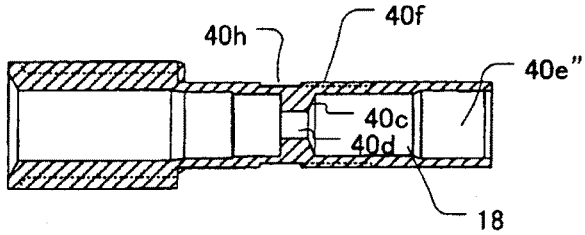
FIG. 9 is a sectional view of the rotating cam and showing yet another example of air communication means formed in the rotating cam.

As the air communication means formed in the rotating cam 40, in place of the air communication hole 40*e*, it is also possible to employ an air communication groove 40*e*' formed in an inner peripheral surface of the rear portion of the rotating cam 40 or an enlarged portion 40*e*" formed by increasing an inside diameter of the inner peripheral surface of the rear portion of the rotating cam 40 as shown in FIG. 8 or 9.

The tip end chip 32 may include an arbitrary member such as a chip having a ball, felt, brush, and a nozzle for supplying a liquid to the outside according to a kind of the liquid supply device. If the liquid supply device is a ballpoint pen and the tip end chip 32 is a chip having a ball and especially a large ball having a diameter of 1 mm or larger, an amount of consumption of ink flowing through the ball is so large that an amount of ink supplied from the tank tube 34 to the ball does not keep up with it and problematically writing fades. However, it has been found that the fading can be prevented by providing the pressurizing space which is compressed to pressurize the inside of the tank tube 34 of the liquid housing tube 14 when the tip end chip 32 is in the protruding position.

As described above, the pressurizing space which is compressed to pressurize the inside of the liquid housing tube when the tip end supplying portion is in the protruding position is preferably applied to a ballpoint pen having a ball diameter of 1 mm or larger.

In the above example, the part described as the single part may be formed as a plurality of parts or the parts described as the plurality of parts may be formed as a single part.

REFERENCE SIGNS LIST

10 liquid supply device
12 outer shaft
14 liquid housing tube
16 rotating cam mechanism
18 pressurizing space
32 tip end chip (tip end supplying portion)
40 rotating cam
40*c* partition wall
40*d* communication hole
40*e* air communication hole (air communication means)
40*e*' air communication groove (air communication means)
40*e*" enlarged portion (air communication means)
40*f* locking protrusion
40*g* locking groove
42 push-out member
42*e* protrusion
46 piston
50 backward displacement regulating mechanism
52 packing cylinder (sealing member)
54 knock spring (biasing member)

The invention claimed is:

1. A liquid supply device comprising:

an outer shaft;

a liquid housing tube disposed to be movable in an axial direction in the outer shaft, having a tip end supplying portion movable between a protruding position from a tip end of the outer shaft and a retracting position in the outer shaft, and housing a liquid;

a rotating cam mechanism capable of moving the liquid housing tube forward and backward, including a rotating cam movable between a front position and a rear position in which the rotating cam can be switched between the front position and the rear position due to axial movement and rotation of the rotating cam; and a pressurizing space provided in the outer shaft and compressed to be able to pressurize an inside of the liquid housing tube when the tip end supplying portion is in the protruding position, wherein the rotating cam is adapted to receive an axial forward force from the pressurizing space.

2. The liquid supply device according to claim 1, wherein the pressurizing space is formed in a back portion in the rotating cam or behind the rotating cam.

3. The liquid supply device according to claim 2, wherein an air communication means for connecting the pressurizing space and atmospheric pressure is formed at a rear portion of the rotating cam.

4. The liquid supply device according to claim 1, wherein the rotating cam mechanism includes a piston capable of compressing the pressurizing space and the piston is movable with respect to the rotating cam.

5. The liquid supply device according to claim 4, wherein the pressurizing space is formed in a back portion in the rotating cam or behind the rotating cam.

6. The liquid supply device according to claim 5, wherein an air communication means for connecting the pressurizing space and atmospheric pressure is formed at a rear portion of the rotating cam.

7. The liquid supply device according to claim 4, wherein the rotating cam mechanism has a push-out member capable of pressing the rotating cam in the axial direction so as to cause axial movement of the rotating cam and the piston is integrally provided with the push-out member.

8. The liquid supply device according to claim 7, wherein the pressurizing space is formed in a back portion in the rotating cam or behind the rotating cam.

9. The liquid supply device according to claim 8, wherein an air communication means for connecting the pressurizing space and atmospheric pressure is formed at a rear portion of the rotating cam.

10. The liquid supply device according to claim 7, wherein a biasing member for biasing the push-out member backward with respect to the rotating cam is interposed between the push-out member and the rotating cam and the push-out member can move further backward after the rotating cam moves to the rear position.

11. The liquid supply device according to claim 7, wherein a backward displacement regulating mechanism for regulating backward displacement of the push-out member when the rotating cam is in the front position is provided between the push-out member and the rotating cam.

12. The liquid supply device according to claim 11, wherein the backward displacement regulating mechanism is a protrusion formed on a surface of one of the rotating cam and the push-out member facing the other of them, a locking protrusion to be engaged with the protrusion, and a locking groove into which the protrusion can be inserted, the locking protrusion and the locking groove formed on a surface of the other of the rotating cam and the push-out member and facing the one of them, and the locking protrusion and the locking groove are formed alternately in a circumferential direction.

13. The liquid supply device according to claim 1, wherein a dividing wall for partitioning an inner portion of the rotating cam into a front portion and a back portion is formed in the rotating cam, the pressurizing space is formed behind the partitioning wall of the rotating cam, and a communication hole for communicating with the liquid housing tube is formed in the partitioning wall.

14. The liquid supply device according claim 1, wherein a sealing member is provided between the rotating cam and a rear end or a peripheral surface of the liquid housing tube.

* * * * *